US006798889B1

(12) United States Patent
Dicker et al.

(10) Patent No.: US 6,798,889 B1
(45) Date of Patent: Sep. 28, 2004

(54) METHOD AND APPARATUS FOR MULTI-CHANNEL SOUND SYSTEM CALIBRATION

(75) Inventors: Sam Dicker, Santa Cruz, CA (US); Jean-Marc Jot, Aptos, CA (US); Nathan Hill, Sandy, UT (US); Vincent Cheng, Singapore (SG)

(73) Assignee: Creative Technology Ltd., Singapore (SG)

( * ) Notice: Subject to any disclaimer, the term of this patent is extended or adjusted under 35 U.S.C. 154(b) by 726 days.

(21) Appl. No.: 09/711,990

(22) Filed: Nov. 13, 2000

Related U.S. Application Data

(60) Provisional application No. 60/165,105, filed on Nov. 12, 1999.

(51) Int. Cl.[7] ..... H04R 5/02
(52) U.S. Cl. ..... 381/303; 381/307; 381/103
(58) Field of Search ..... 381/300, 307, 381/303, 310, 119, 103

(56) References Cited

U.S. PATENT DOCUMENTS 5,666,424 A * 9/1997 Fosgate et al. ..... 381/18
6,490,359 B1 * 12/2002 Gibson ..... 381/119
6,639,989 B1 * 10/2003 Zacharov et al. ..... 381/303

OTHER PUBLICATIONS

Jot, Jean–Marc, Spatialisateur Espaces Nouveaux/Ircam, The Spat—Processor and its Library of Max Objects, Introduction, First Edition Mar. 1995, (48 pgs.), Ircam, Paris France.

* cited by examiner

*Primary Examiner*—Minsun Oh Harvey
*Assistant Examiner*—Brian Pendleton
(74) *Attorney, Agent, or Firm*—Blakely, Sokoloff, Taylor & Zafman LLP

(57) ABSTRACT

A calibration system for calibrating multi-channel sound systems. The calibration system includes a method for calibrating a sound system that includes a plurality of loudspeakers. The method includes steps of mapping the plurality of loudspeakers into a virtual loudspeaker system representation displayable to a user, activating at least one calibration function that creates a calibration signal that is reproduced by one or more of the plurality of loudspeakers to produce a calibration sound perceivable by the user, modifying the virtual loudspeaker system representation to include a virtual calibration indicator that indicates a characteristic of the calibration signal, and adjusting the virtual calibration indicator based on a user input, wherein when the virtual calibration indicator is adjusted, a corresponding adjustment is made to the characteristic of the calibration signal until a selected calibration sound is achieved.

5 Claims, 13 Drawing Sheets

"PRIOR ART"

METHOD AND APPARATUS FOR MULTI-CHANNEL SOUND SYSTEM CALIBRATION

CROSS-REFERENCES TO RELATED APPLICATIONS

This application claims priority from a co-pending U.S. Provisional Patent Application No. 60/165,105 entitled SPEAKER CALIBRATOR/FORMAT CONVERTER filed on Nov. 12, 1999, the disclosure of which is incorporated herein in its entirety for all purposes.

FIELD OF THE INVENTION

The invention relates generally to the field of sound reproduction systems, and more particularly, to a calibration system for calibrating multi-channel sound reproduction systems.

BACKGROUND OF THE INVENTION

With the advent of multi-channel 3-D sound systems that combine a loudspeaker playback system and a multi-channel sound processor (e.g., Soundblaster LIVE!, manufactured by assignee of the present application), calibration and tuning of the sound system is necessary for the listener to experience the maximum benefit.

FIG. 1 shows a representation of a top view of a listening room 150 that includes four loudspeakers 152, 154, 156 and 158. The loudspeakers have been positioned in the listening room by a listener 160 who is positioned at a particular listening position in the room. Due to the geometry of the room and the position of the listener, the loudspeakers are located at positions that are not equidistant from the listener or uniformly spaced. Furthermore, the loudspeakers may have different electro-acoustic characteristics (for instance, some of the loudspeakers may be from different manufacturers).

As a result of loudspeaker characteristics and/or of the loudspeaker and listener positions in FIG. 1, sounds that are reproduced by the loudspeakers may not achieve their intended sound qualities. For example, the perceived spatial positions of the sounds may not appear to the listener as intended. Also, the positions of the loudspeakers may introduce subtle distortion effects such as phase or delay mismatches that can degrade the quality of the perceived sound.

Thus, many users purchase multi-loudspeaker systems but do not experience the intended 3-D sound experience because they are unable to position the loudspeakers correctly or are unable to calibrate the characteristics of the multi-loudspeaker sound system properly to achieve the intended and desired sound quality.

SUMMARY OF THE INVENTION

The present invention includes a calibration system that allows users of multi-channel loudspeaker systems to calibrate their sound systems properly to achieve the intended sound quality. According to one aspect of the present invention, an intuitive, interactive system and method for calibrating sound systems includes graphical displays to guide a user through a calibration session.

According to another aspect of the invention, a virtual room with virtual loudspeaker systems is displayed and the user interacts with mobile elements of the virtual representation to calibrate his/her sound system according to the location and/or characteristics of the real loudspeakers connected to it.

According to another aspect of the invention, the user can adjust the perceived sound quality by modifying the layout of the virtual loudspeaker systems in the virtual representation in order to match the layout of the real loudspeakers with respect to the listener's position.

According to another aspect of the invention, the user's interaction with the virtual representation causes the production of test signals over the real loudspeakers, and allows the user to adjust aspects of the perceived sound quality of this sound stimulus.

In one embodiment of the invention, a method is provided for calibrating a sound system that includes a plurality of loudspeakers. The method comprises steps of mapping the plurality of loudspeakers into a virtual loudspeaker system representation displayable to a user, activating at least one calibration function that creates a calibration signal that is reproduced by one or more of the plurality of loudspeakers to produce a calibration sound perceivable by the user, modifying the virtual loudspeaker system representation to include a virtual calibration indicator that indicates a characteristic of the calibration signal and adjusting the virtual calibration indicator based on a user input, wherein when the virtual calibration indicator is adjusted, a corresponding adjustment is made to the characteristic of the calibration signal until a selected calibration sound is achieved.

In another embodiment of the invention, apparatus is provided for calibrating a sound system that includes a plurality of loudspeakers. The apparatus comprises a display, an input device operable by a user, a sound generator coupled to the loudspeakers, the sound generator generates at least one calibration signal that has at least one characteristic, the at least one calibration signal is reproduced by one or more of the loudspeakers to produce a calibration sound that is perceivable by the user, and a processor coupled to the display, the input device and the sound generator, the processor is operable to map the plurality of loudspeakers into a virtual loudspeaker system representation that is displayable to the user on the display, activate the sound generator to generate the at least one calibration signal, modify the virtual loudspeaker system representation to include a virtual calibration indicator that indicates the at least one characteristic of the at least one calibration signal, and adjust the virtual calibration indicator based on a user input, wherein when the virtual calibration indicator is adjusted, a corresponding adjustment is made to the characteristic of the calibration signal until a selected calibration sound is achieved.

Other features and advantages of the invention will be apparent in view of the following detailed description and appended drawings.

DESCRIPTION OF THE SPECIFIC EMBODIMENTS

A sound system calibration system included in the present invention will now be described in detail. The description describes an exemplary apparatus suitable to implement an embodiment of the present invention. Methods of operation and associated user interface details in accordance with the invention are also provided.

Figure 1:
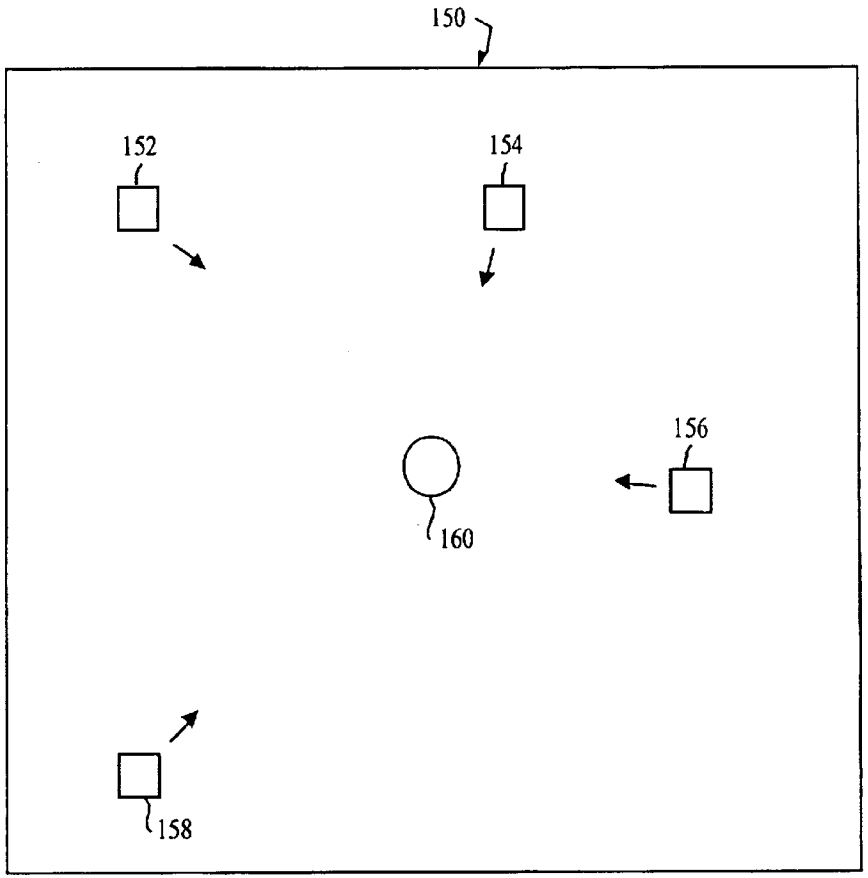
FIG. 1 shows a typical listening room that includes a sound system that may produce degraded sound quality because of the loudspeaker characteristics and the loudspeaker positions with respect to a listener.
Figure 2:
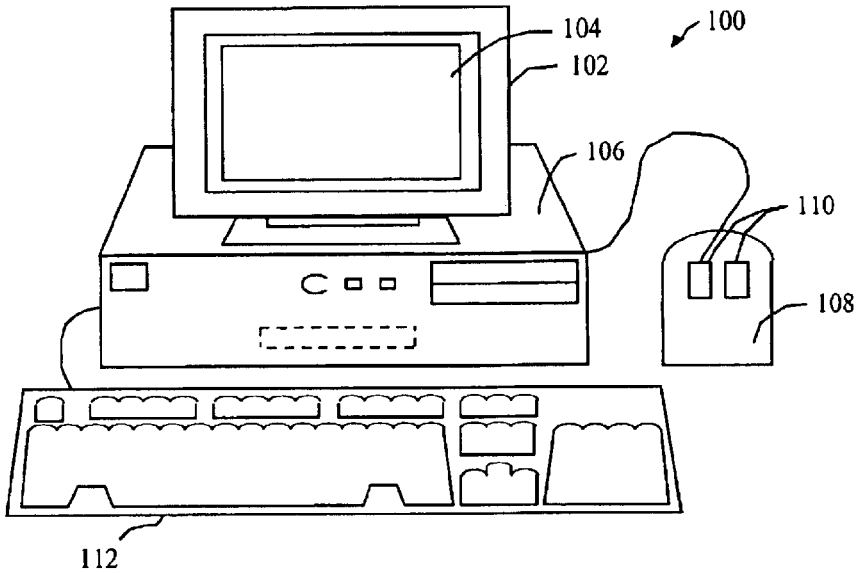
FIG. 2 shows a computer device suitable for use with embodiments of the present invention.

FIG. 2 shows a computer device 100 suitable for use to provide a calibration system in accordance with the present invention. Computer device 100 includes display 102 having display screen 104. Cabinet 106 houses standard computer components (not shown) such as a disk drive, CDROM drive, display adapter, network card, random access memory (RAM), central processing unit (CPU), and other components, subsystems and devices. User input devices such as a mouse 108 having buttons 110, and a keyboard 112 are shown. Other user input devices such as a trackball, touch-screen, digitizing tablet, etc. can be used. In general, the computer device 100 is illustrative of one type of computer system, such as a desktop computer, suitable for use with the present invention. Computers can be configured with many different hardware components and can be made in many dimensions and styles (e.g., laptop, palmtop, server, workstation, mainframe). Thus, any hardware platform suitable for performing the processing described herein is suitable for use with the present invention.

Figure 3:
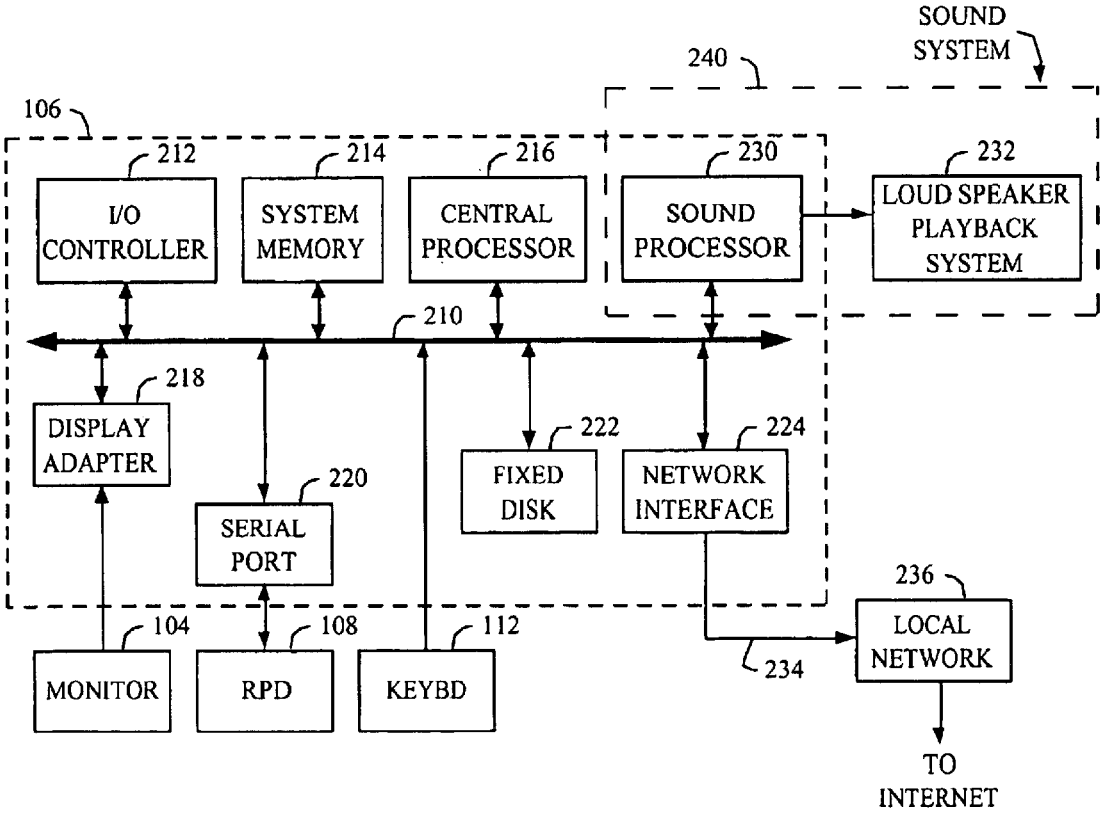
FIG. 3 shows components within the computer device of FIG. 2.

FIG. 3 illustrates subsystems found in the computer device 100. Subsystems within box 106 are directly interfaced to an internal bus 210. The subsystems include input/output (I/O) controller 212, System Random Access Memory (RAM) 214, Central Processing Unit (CPU) 216, Display Adapter 218, Serial Port 220, Fixed Disk 222, Network Interface Adapter 224 and sound processor 230. The use of the bus 210 allows each of the subsystems to transfer data among the subsystems and, most importantly, with the CPU 216. External devices can communicate with the CPU or other subsystems via the bus 210 by interfacing with a subsystem on the bus. Monitor 104 connects to the bus through Display Adapter 218. A relative pointing device (RPD) such as a mouse 108 connects through Serial Port 220. Some devices such as keyboard 112 can communicate with the CPU 216 by direct means without using the main data bus as, for example, via an interrupt controller and associated registers (not shown). Also shown is a Loudspeaker Playback System 232, which receives sound signals from the Sound Processor 230 to acoustically reproduce the sound signals for user enjoyment. In the embodiment illustrated on FIG. 3, the union of the Sound processor 230 and the Loudspeaker Playback System 232 form the Sound System 240.

FIG. 3 is illustrative of one suitable configuration for providing a calibration system in accordance with the present invention. Subsystems, components or devices other than those shown in FIG. 3 can be added without deviating from the scope of the invention. A suitable computer system can also be achieved without using all of the subsystems shown in FIG. 3. Other subsystems such as a CDROM drive, graphics accelerator, etc. can be included in the configuration without affecting the performance of the calibration system included in the present invention.

In one embodiment, the sound processor 230, in conjunction with other components of the computer system 100, provides a calibration system allowing a user to calibrate the sound system 240. Thereafter, sounds reproduced by the sound system 240 will have the desired sound qualities. For example, after calibration, sound signals from a CDROM (not shown) coupled to bus 210 will be received by the sound processor 230, adjusted by parameters derived from the calibration system, and then reproduced by the sound system 240 for enjoyment by the listener.

Figure 4:
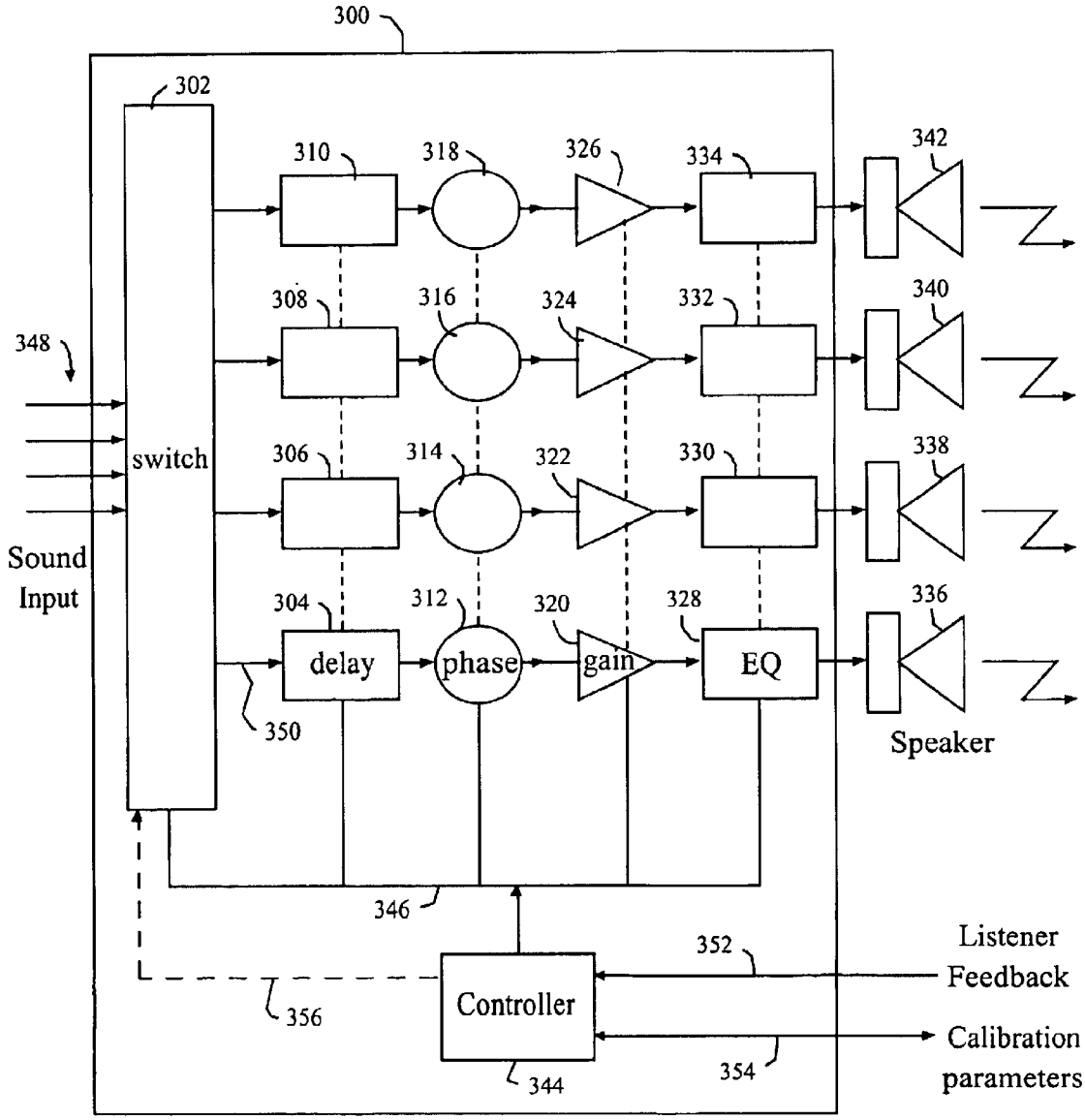
FIG. 4 shows a functional diagram of a sound system calibration processor included in the sound processor of FIG. 3 and constructed in accordance with the present invention.

FIG. 4 shows a functional diagram of a sound system calibration processor 300 included in the sound processor 230 and constructed in accordance with the present invention. The functions provided by the calibration processor 300 may also be implemented, for example, by various components in the computer device 100, or may be implemented within a stand-alone sound system, such as in a music entertainment center provided for home use or a sound system manufactured for an automobile. Sound system calibration provided by the calibration processor 300 can be used to calibrate a sound system that includes four loudspeakers, however, it would be obvious to one skilled in the art to modify the functions of the calibration processor 300 to operate with fewer or more than four loudspeakers.

The calibration processor 300 includes a switch 302 and four sound channels that include delays (304, 306, 308, 310), phase adjusters (312, 314, 316, 318), gain adjusters (320, 322, 324, 326), equalization adjusters (328, 330, 332, 334). The outputs of the sound processor 230 are coupled to loudspeakers (336, 338, 340, 342). The sound processor 230 also includes a controller 344 that is used to adjust functional elements of the sound processor via a control bus 346 and/or generate test signals.

Sound inputs 348, which are received via bus 210, are provided at switch 302 and can be redirected to any of the four sound channels based on control instructions sent to the switch 302 from the controller 344. For example, the switch can redirect any of the sound inputs 348 to appear at channel input 350. Thus, the controller controls the switch to determine which of the sound inputs 348 are reproduced at the loudspeakers (336, 338, 340, 342).

The delay adjusters (304, 306, 308, 310) adjust the delay of each channel based on instructions from the controller 344. By adjusting the channel delays, it is possible to configure the sound system 240 so that sounds reproduced at the loudspeakers arrive at the listener at the desired times. Adjusting the sound arrival times affects how the spatial positions of the sounds are perceived by the listener. Thus, the delay adjusters (304, 306, 308, 310) adjust the spatial positions of the reproduced sounds to compensate for the physical placement of the loudspeakers with respect to the position of the listener. In particular, the relative duration of the delay units (304, 306, 308, 310) can be adjusted to compensate for the differences in distance from each loudspeaker to the center of the listener's head.

The phase adjusters (312, 314, 316, 318) adjust the phase of each channel based on instructions from the controller 344. Phase adjustment corrects a situation where the loudspeakers are connected with different polarities so that the sounds reproduced by two loudspeakers are out of phase with each other.

The gain adjusters (320, 322, 324, 326) adjust the gain of each channel based on instructions received from the controller 344. The gain adjusters adjust the volume of sound reproduced by each channel so that it is possible to balance the volume of all channels relative to the position of the listener.

The equalization adjusters (328, 330, 332, 334) adjust the equalization of each channel based on instructions received from the controller 344. The equalization adjusters compensate for loudspeaker mismatches (for instance, where a sound system includes loudspeakers that are manufactured by different manufacturers, and as a result, have different frequency responses). The equalization adjusters adjust the high and low frequency response of each channel. For example, the treble and bass of each channel can be adjusted. Thus, it is possible to compensate for frequency response mismatches between the loudspeakers, or correct certain effects of the listening room's acoustics by using the equalization adjusters.

The controller 344 controls the other elements of the processor 300 by providing instructions that are used to adjust each element. A summary representation of the parameters of the calibration processor controlled by the controller 344 is given in FIG. 13, which is described in another section of this description. The controller 344 determines what instructions to send based on information received from a listener and relayed to the controller 344 via the bus 210. Thus, listener feedback is used by the controller to adjust elements of the calibration processor 300.

As will be described in detail in another section of this document, the controller 344 provides instructions to affect the reproduction of test signals that are perceivable by the listener. Such test signals are received on sound inputs 348 and generated within the sound processor 230 or, alternatively, transmitted to the sound processor 230 via the bus 210 from the CPU 216 or from some other source external to computer 100. In one embodiment, the test signals are generated by the controller 344 and input to the switch 302 via signal path 356. Thus, test signals may be received from many sources and eventually input to the switch 302 for distribution to the loudspeakers in the sound system.

After perceiving the test signals, the listener then provides feedback (via a user input device) that is relayed to the controller via the bus 210 and the feedback input 352. The feedback is used by the controller 344 to determine what instructions to send to the elements of the calibration processor 300 in order to complete the calibration. A detailed description of the instructions used to control the elements of the calibration processor 300 will not be provided herein since such instructions details are not relevant to the description of the invention. For example, it is well known that many types of instructions could be used to instruct the gain adjusters to increase or decrease their respective gain factors.

Additionally, a parameter channel 354 is provided to allow calibration parameters or instructions to be exchanged between the processor 300 and the system processor 216. Thus it is possible that calibration parameters can be determined by the calibration processor 300, sent to the system processor 216 and thereafter stored in memory 214. Alternatively, calibration parameters stored in memory 214 can be retrieved from the system processor 216 and transmitted to the calibration processor 300 to allow previously determined calibration parameters to be restored. It is also possible that the central processor 216 provides instructions to the controller 344 via the channel 354 to initiate or facilitate the calibration process.

Figure 5:
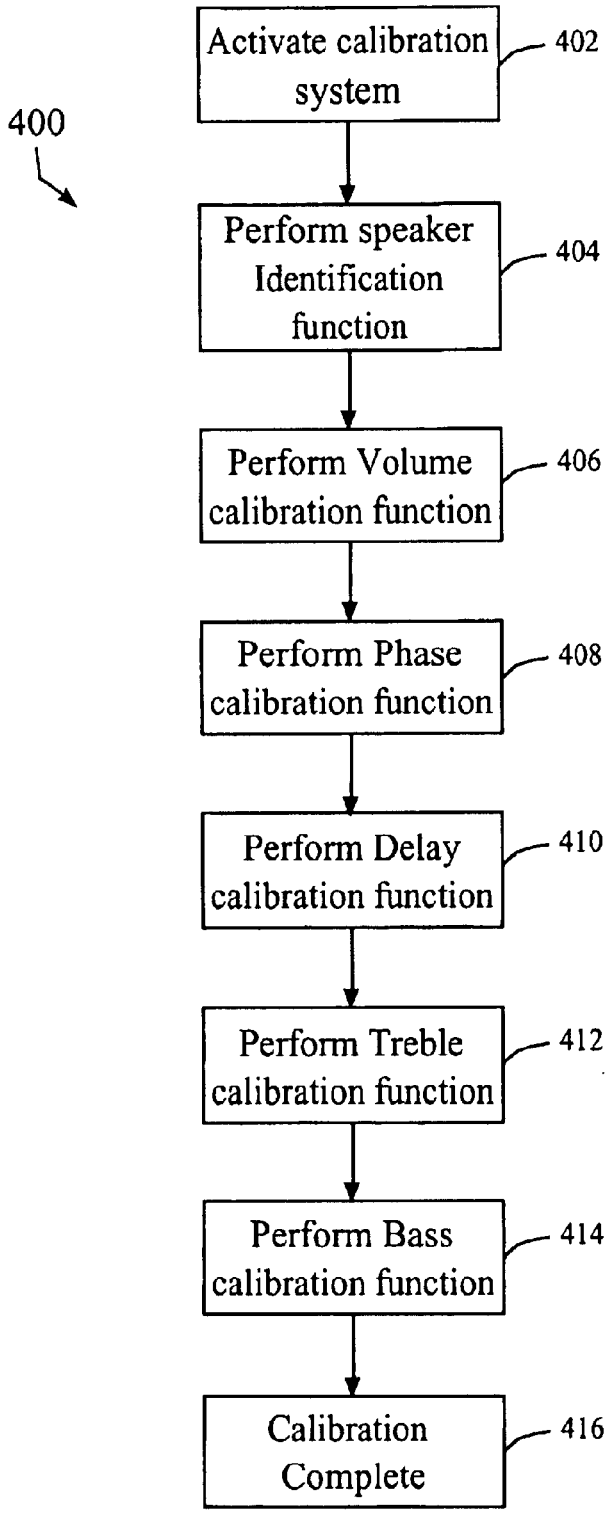
FIG. 5 shows a method of performing sound system calibration in accordance with the present invention.

FIG. 5 shows a method 400 that provides a sequence of calibration steps to allow a user to perform a sound system calibration in accordance with the present invention. The ordering of steps presented in FIG. 5 illustrates a preferred embodiment of a complete calibration procedure whereby the completion of the earlier calibration steps make the subsequent calibration steps more effective and easier for the user. However, a sound system calibration in accordance with the present invention can skip several of the steps described in FIG. 5 and/or execute them in a different order than described in FIG. 5. The method is described with reference to calibrating a sound system having four loudspeakers. However, it would be obvious to one with skill in the art that minor modifications can be made to use the method to calibrate sound systems having two or more loudspeakers without deviating from the scope of the invention. Therefore, for the purposes of this description, it will be assumed that the listener has coupled a four-channel loudspeaker playback system to the output of a sound processing system, such as sound processor 230 including calibration processor 300. Although the method 400 describes specific calibration functions, a detailed description of each calibration function is provided in another section of this document. It would be obvious to one skilled in the art that modifications to the described calibration functions can be made without deviating from the scope of the present invention. Furthermore, it is possible that other calibration functions not described herein are possible and may be incorporated with minor modifications and without deviating from the scope of the invention.

At block 402, the listener moves to a specific position relative to the loudspeakers of the sound system to be calibrated. Usually, this position is a comfortable listening position where the listener is approximately equally distant from all the loudspeakers. From this position, the listener can access a user input device that provides user feedback to the calibration system. The listener then activates the calibration system.

At block 404, the method begins by performing a loudspeaker identification function. In this step, the listener verifies that each signal from the sound processing system is fed to the appropriate loudspeaker. For example, this step ensures that the signal for the left-front loudspeaker is actually fed to the left-front loudspeaker. This is accomplished, for example, by the loudspeaker calibration system emitting a sound signal for each loudspeaker and receiving verification feedback from the listener via the feedback device. If it is determined that one or more loudspeakers are not correctly connected, the loudspeaker calibration system re-assigns the loudspeaker signals to the appropriate loudspeakers to correct the mis-connection. This is accomplished without physically reconnecting the loudspeakers. For example, if the connections to the front left and right loudspeakers are reversed, so that the signal for the left loudspeaker is coupled to the right loudspeaker and vice versa, it is possible to correct the mis-connection by, for example, adjusting switch 302 to redirect the loudspeaker signals to the appropriate loudspeakers. In the event of a non-functioning loudspeaker, such as if a loudspeaker is damaged, the calibration system provides an indication to the listener of this condition. The listener then may take steps to correct the problem. Assuming all the loudspeakers have been properly identified and connected to the appropriate sound signal, the method proceeds to block 406.

At block 406, the method performs a volume balancing function. Volume balancing corrects for volume differences that the listener may perceive due to the relative positioning of the loudspeakers and the listener. For example, the left-front loudspeaker may be closer to the listener than any other loudspeaker. As a result, the listener may perceive sounds reproduced by the sound system to have different spatial positions than intended. For example, a singer's voice may be perceived to be closer or farther from the listener than originally intended, or a sound intended to appear between to loudspeakers may be perceived to originate closer to one loudspeaker.

To accomplish volume balancing, a special volume-balancing test signal is provided to at least two loudspeakers at a time. The listener provides feedback to the calibration system to adjust the volume-balancing signal so that the sound is balanced between the loudspeakers. In the case of a four-channel sound system, the process is repeated until the volume for all the loudspeakers has been balanced.

At block 408, the method performs a phase correction test. It is possible that two or more loudspeakers may be connected so that they are out of phase with each other or other loudspeakers in the system. This may occur, for example, if the polarity of the connection to a loudspeaker is reversed with respect to another loudspeaker.

To accomplish phase correction, a special phase-correction test signal is produced at two or more of the loudspeakers and the listener interacts with the calibration system to adjust the signal so that the activated loudspeakers have identical phase with respect to one another. This results in eliminating the effects produced when one or more loudspeakers are out of phase with respect to other loudspeakers.

At block 410, the method performs a delay balancing function. Delay balancing is a process similar to that of volume balancing. Audio signals take time to travel in air. For example, the further the loudspeaker is from the listener, the longer it takes to reach the listener. When the relative delay between loudspeakers sound perceived at the listening position is significant, a slight "wooshy" flanging sound (an undesirable audio artifact) may become detectable. When the relative delay is small (for example, approximately less than 1 millisecond), the apparent position of certain sounds reproduced through the loudspeakers may not be the intended location. For instance, a sound intended to appear between to loudspeakers may be perceived to originate closer to one loudspeaker.

To accomplish delay balancing, a special delay balancing test signal is produced at two or more of the loudspeakers and the listener interacts with the calibration system to adjust the signal so that the activated loudspeakers have identical delay with respect to the position of the listener. This results in minimizing the perceivable timbral and positional artifacts due to delay mismatches.

At block 412, the method performs a treble balancing function. The treble balancing function is useful when a sound system includes loudspeakers constructed by different manufacturers. For example, in a four-channel system, the front two loudspeakers may have been purchased from one manufacturer and the rear two loudspeakers purchased from another manufacturer. Each loudspeaker manufacturer has their own loudspeaker design, and as a result, there is a possibility that the frequency response of loudspeakers from one manufacturer does not match the frequency response of loudspeakers from another manufacturer. When playing music on such a loudspeaker system, this situation may create an "unbalanced" quality to the sound that is detectable by a listener.

To accomplish treble balancing, a special treble-balancing test signal is provided to at least two loudspeakers and the listener provides feedback to the sound system to adjust the sound signal so that the sound is balanced between the loudspeakers. In the case of a four-channel loudspeaker system, the process is repeated until the treble for all the loudspeakers has been balanced.

At block 414, the method performs a bass balancing function. As in treble balancing, the bass balancing function is useful when a loudspeaker system includes loudspeakers constructed by different manufacturers that have different frequency responses. When playing music on such a loudspeaker system, this situation may create an "unbalanced" quality to the sound that is detectable by a listener.

To accomplish bass balancing, a special bass-balancing test signal is provided to at least two loudspeakers and the listener provides feedback to the sound system to adjust the sound signal so that the sound is balanced between the loudspeakers. In the case of a four-channel loudspeaker system, the process is repeated until the bass for all the loudspeakers has been balanced.

At block 416, the calibration method is complete and the loudspeaker system is now ready to accurately produce multi-channel sound as intended by design. At this step, the results can be stored into a memory for later retrieval. It is also possible that calibration results can be retrieved from a memory and then any of the above defined calibration method steps can be repeated to update the overall calibration.

The invention is related to the use of apparatus, such as computer system 100, for performing sound system calibrations. According to one embodiment of the invention, sound system calibration is provided by computer system 100 in response to processor 216 executing one or more sequences of one or more instructions contained in system memory 214. Such instructions may be read into memory 214 from another computer-readable medium, such as fixed disk 222. Execution of the sequences of instructions contained in memory 214 causes processor 216 to perform the process steps described herein. One or more processors in a multi-processing arrangement may also be employed to execute the sequences of instructions contained in memory 214. For example, controller 344 may also contain a processor that executes instructions contained in system memory 214 to perform the process steps described herein. In alternative embodiments, hard-wired circuitry may be used in place of or in combination with software instructions to implement the invention. Thus, embodiments of the invention are not limited to any specific combination of hardware circuitry and software.

The term "computer-readable medium" as used herein refers to any medium that participates in providing instructions to processor 214 for execution. Such a medium may take many forms, including, but not limited to, non-volatile media, volatile media, and transmission media. Non-volatile media include, for example, optical or magnetic disks, such as fixed disk 222. Volatile media include dynamic memory, such as memory 214. Transmission media include coaxial cables, copper wire, and fiber optics, including the wires that comprise bus 210. Transmission media can also take the form of acoustic or light waves, such as those generated during radio frequency (RF) and infrared (IR) data communications. Common forms of computer-readable media include, for example, floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EPROM, any other memory chip or cartridge, a carrier wave as described hereinafter, or any other medium from which a computer can read.

Various forms of computer-readable media may be involved in carrying one or more sequences of one or more instructions to processor 216 for execution. For example, the instructions may initially be borne on a magnetic disk of a remote computer. The remote computer can load the instructions into its dynamic memory and send the instructions over a telephone line using a modem. A modem local to computer system 100 can receive the data on the telephone line and use an infrared transmitter to convert the data to an infrared signal. An infrared detector coupled to bus 210 can receive the data carried in the infrared signal and place the data on bus 210. Bus 210 carries the data to memory 214, from which processor 216 retrieves and executes the instructions. The instructions received by memory 214 may optionally be stored on fixed disk 222 either before or after execution by processor 216.

Computer system 100 also includes a communication interface 224 coupled to bus 210. Communication interface 224 provides a two-way data communication coupling to a network link 234 that is connected to a local network 236. For example, communication interface 224 may be an integrated services digital network (ISDN) card or a modem to provide a data communication connection to a corresponding type of telephone line. As another example, communication interface 224 may be a local area network (LAN) card to provide a data communication connection to a compatible LAN. Wireless links may also be implemented. In any such implementation, communication interface 224 sends and receives electrical, electromagnetic, or optical signals that carry digital data streams representing various type of information.

Network link 234 typically provides data communication through one or more networks to other data devices. For example, network link 234 may provide a connection through local network 236 to a host computer or to data equipment operated by an Internet Service Provider (ISP). The ISP in turn provides data communication services through the worldwide packet data communication network, now commonly referred to as the "Internet."Local network 236 and the Internet both use electrical, electromagnetic, or optical signals that carry digital data streams. The signals through the various networks and the signals on network link 234 and through communication interface 224, which carry the digital data to and from computer system 100, are exemplary forms of carrier waves transporting the information.

Computer system 100 can send messages and receive data, including program codes through the network(s), network link 234, and communication interface 224. In the Internet example, a server might transmit a requested code for an application program through Internet, ISP, local network 236, and communication interface 224. In accordance with the invention, one such downloaded application provides for sound system calibration as described herein. The received code may be executed by processor 216 as it is received, and/or stored on fixed disk 222, or other non-volatile storage for later execution. In this manner, computer system 100 may obtain an application code in the form of a carrier wave.

Exemplary Implementation

The following is an exemplary implementation of a calibration system constructed in accordance with the present invention. The following implementation consists of hardware, such as computer system 100, executing program code to perform sound system calibration according to one embodiment of the present invention.

Figure 6:
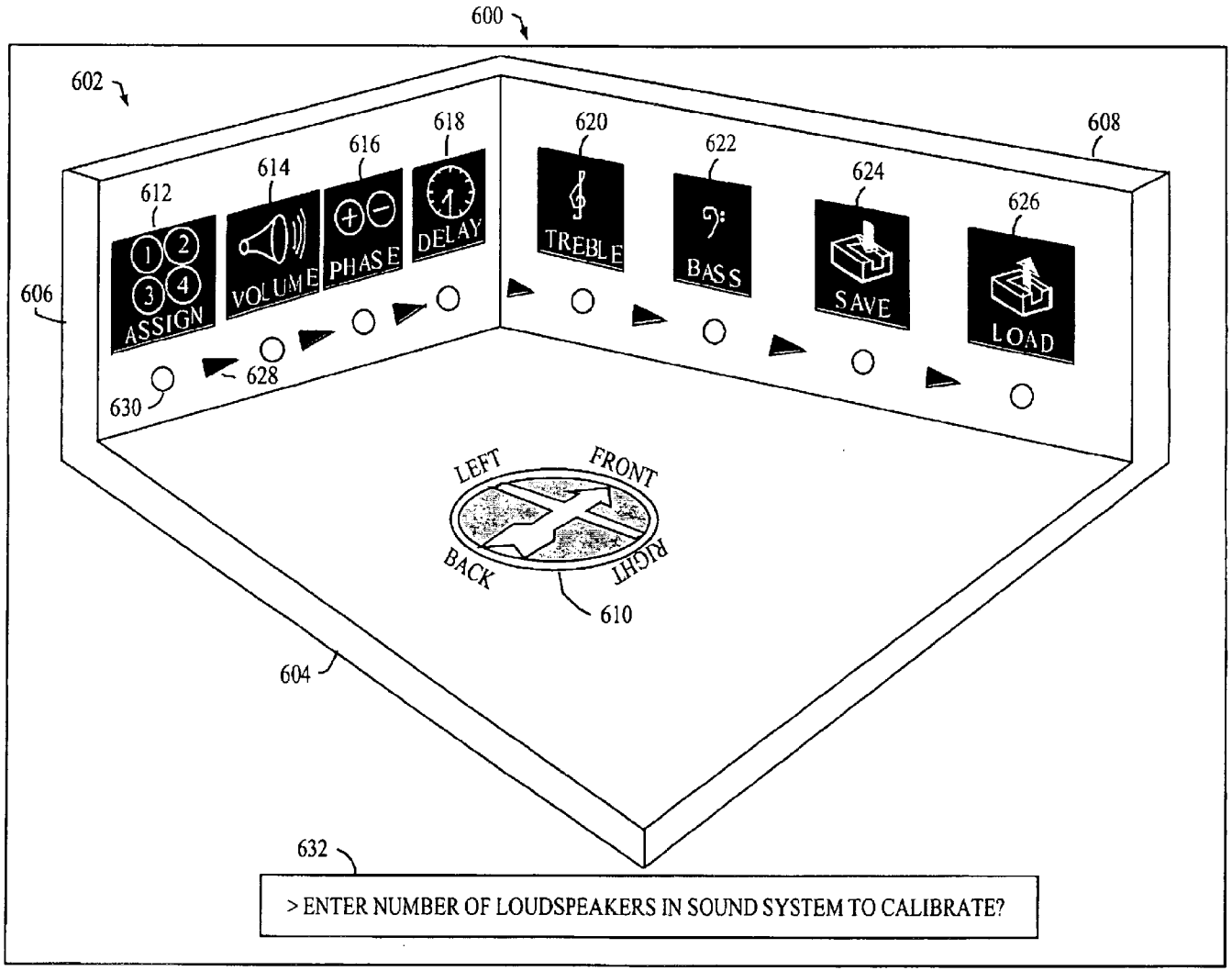
FIG. 6 shows a calibration display screen that is displayed to a user after activating the calibration system.

FIG. 6 shows a screen display 600 provided to a user after launching the calibration application program. A virtual room 602 appears that has a floor 604, a first wall 606 and a second wall 608. The floor is marked with front/back and left/right direction indications 610. The first and second walls include calibration icons that allow the user to activate specific calibration functions. The calibration icons includes a loudspeaker assignment icon 612, a volume adjustment icon 614, a phase adjustment icon 616, a time delay adjustment icon 618, a treble adjustment icon 620, a bass adjustment icon 622, a save icon 624 and a load icon 626. Arrow icons, such as arrow icon 628, are shown located on the first and second walls to indicate to direct the user from one calibration function to the next. Indicators, such as indicator 630, are used to show the user what calibration function is being performed, so that the user may easily proceed through all the calibration functions. A dialog box 632 provides instructions to the user to direct the user through the calibration process. In the following sections, each of the calibration functions associated with the function icons in room 602 are described in detail.

Loudspeaker Assignment Function

Referring again to FIG. 6, to perform the loudspeaker identification and assignment function, the user clicks on the loudspeaker assignment icon 612. The dialog box shows text that asks the listener to input the number of loudspeakers in the sound system to be calibrated. At this point the listener enters the number of loudspeakers in the sound system, for example, the user enters 4 in response to the question.

In one embodiment of the present invention, after the user has entered the number of loudspeakers in the sound system to be calibrated, the user is offered the option of carrying out a loudspeaker placement calibration step. In the loudspeaker placement calibration step, the user enters into the calibration system the approximate positions of the loudspeakers with respect to the listening position.

Figure 7:
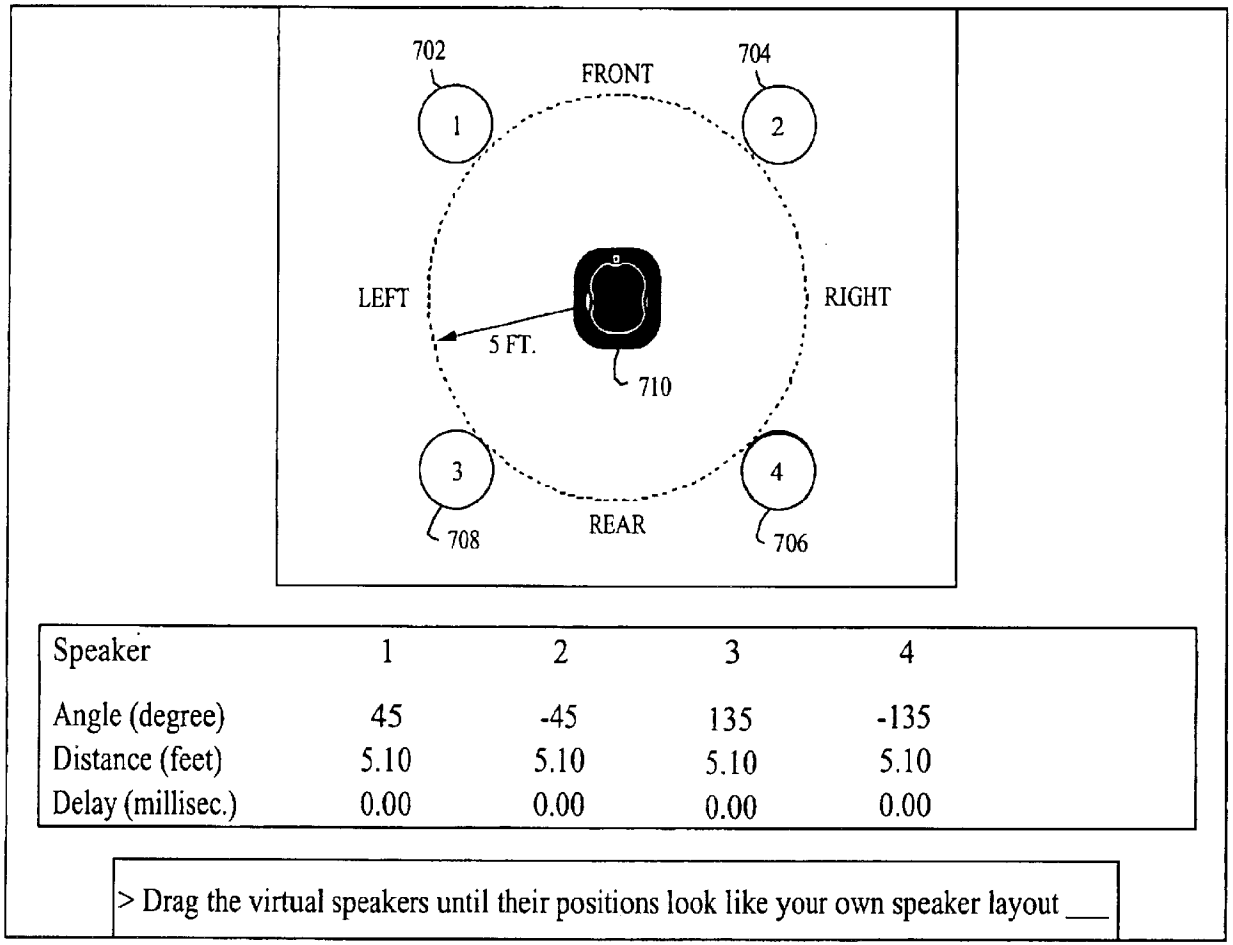
FIG. 7 shows a calibration display screen that is displayed to a user after entering the number of loudspeakers, and that allows the user to modify virtual loudspeaker locations in a representation of a top view of the user's loudspeaker system.

FIG. 7 shows a display screen that provides a top-view representation of the loudspeaker system to be calibrated by the user. The user input device allows the user to modify (by clicking and dragging) the positions of the loudspeakers (702, 704, 706, 708) with respect to the listener position 710 in order to approximately match the positions of the loudspeakers with respect to the listener position in the sound system to be calibrated. For instance, the mouse 108 in the computer system 100 is utilized by the user to drag each loudspeaker to its approximate position in the top-view representation. Thus, in the loudspeaker placement calibration step, the user provides to the calibration system approximate values of the loudspeaker-to-listener distance and of the angular position of the loudspeakers with respect to the frontal direction from the listener. If the sound system to be calibrated is to be used in conjunction with a visual reproduction system using a visual display system such as a computer display or a video monitor, the frontal direction may coincide with the position of the visual display system.

The approximate distance value provided by the loudspeaker placement calibration step for each channel is used by the calibration system to compute values for the delay adjustment and gain adjustment parameters of the calibration processor 300 of FIG. 4. The delay adjusters (304, 306, 308, 310) are set such that the smallest delay value $delay_{min}$ is assigned to the channel feeding the nearest loudspeaker and each channel i is assigned delay value $delay_i$ such that $delay_i - delay_{min} = (dist_i - dist_{min})/c$, where $delay_i$ and $delay_{min}$ are expressed in seconds, $dist_i$ and $dist_{min}$ are expressed in meters, and c is the velocity of sound in air, expressed in meters/second (approximately 340 meters/second). It is possible, but not necessary, for the calibration processor to set $delay_{min}=0$. The gain adjusters (320, 322, 324, 326) are set such that the smallest gain value $gain_{min}$ is assigned to the channel feeding the nearest loudspeaker and each channel i is assigned gain value $gain_i$ such that $gain_i/gain_{min} = dist_i/dist_{min}$. It is possible, but not necessary, for the calibration processor to set $gain_{min}=1$.

If the loudspeaker placement calibration step is not executed, all the delay adjusters are set to the same value $delay_{min}$ and all the gain adjusters are set to the same value $gain_{min}$. The approximate angle value provided by the loudspeaker placement calibration step for each channel is stored by the calibration system and can be used by any device or process providing the sound inputs 348 to the calibration processor 300 in order to ensure that sounds be perceived by the listener at their intended position.

Figure 8:
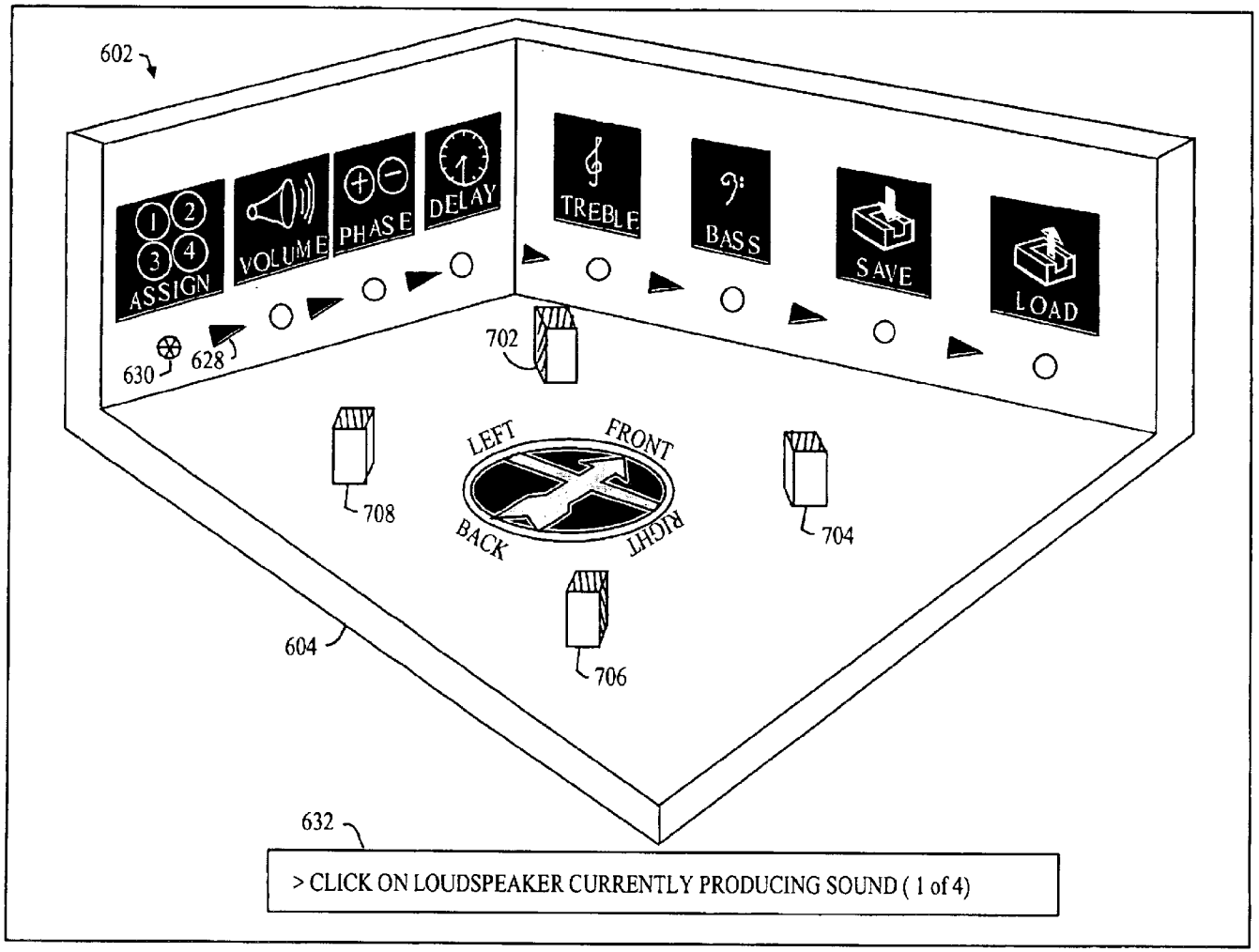
FIG. 8 shows a display screen that is displayed to a user after selecting the channel assignment calibration function.

FIG. 8 shows the room 602 after the user has entered into the calibration system that four loudspeakers are to be calibrated and optionally indicated the approximate loudspeaker locations by moving the loudspeakers represented in FIG. 7. The floor 604 has on it representations of four loudspeakers that correspond to the user's loudspeaker system. In this example, the four loudspeaker representations 702, 704, 706 and 708 are created as shown. Additionally, the indicator 630 indicates that the assignment function is currently active.

During the assignment function, the calibration system plays test signals through each of the loudspeakers and asks the user to click on the loudspeaker representation corresponding to the actual loudspeaker where the sound appears to come from. For the purpose of the loudspeaker assignment function, the test signal can be any music, speech or noise signal that allows the listener to recognize the loudspeaker emitting the test signal. For example, the loudspeaker calibration plays a test signal that manifests itself as a test sound produced from the rear left loudspeaker of the user's sound system. The user clicks on the rear left loudspeaker representation, for example loudspeaker 708. The purpose of this test is to let the calibration system determine the channel identification (ID) for each physical loudspeaker connected to the system. After the user has indicated to the calibration system that the loudspeaker emitting the test signal is the rear left loudspeaker, the switch 302 is configured so that the rear left loudspeaker in the user's sound system will receive the sound input channel 348 that is intended for the rear left loudspeaker. Once this connection has been established in the switch 302, the calibration system plays a test signal on one of the other loudspeakers and a new connection is established in the switch 302, so that the correct sound input channel 348 will be connected to this loudspeaker in the switch 302. The test continues in the same process until the user has identified all of the loudspeakers in the sound system to the calibration system. Should any loudspeaker be found to be defective, the calibration system notifies the user of this event. For example, if the user does not click on a loudspeaker representation within a given amount of time after a test signal for a loudspeaker is activated, the calibration system assumes the loudspeaker is defective and notifies the user via the dialog box 632.

Once all the loudspeakers have been identified the assignment test is complete and the indicator 630 is deactivated. In one embodiment, the arrow indicator 628 is activated to direct the user to the next calibration function.

Volume Calibration

During volume calibration, the user provides feedback to calibrate the volume of each loudspeaker in the sound system. Parameters derived from this function can be used to set the values of the gain adjusters (320, 322, 324, 326) in the calibration processor 300. The initial values of the gain adjusters are set to 1 or provided by the loudspeaker placement calibration executed previously. Thus, dependent on the placement of the loudspeakers relative to the user or on any parameter settings in the external loudspeaker playback system 232 (such as amplification or volume balance settings), the volume for each loudspeaker is calibrated. During the volume calibration function two loudspeakers are calibrated at a time. The user clicks on the volume icon 614 and the volume calibration function begins.

Figure 9:
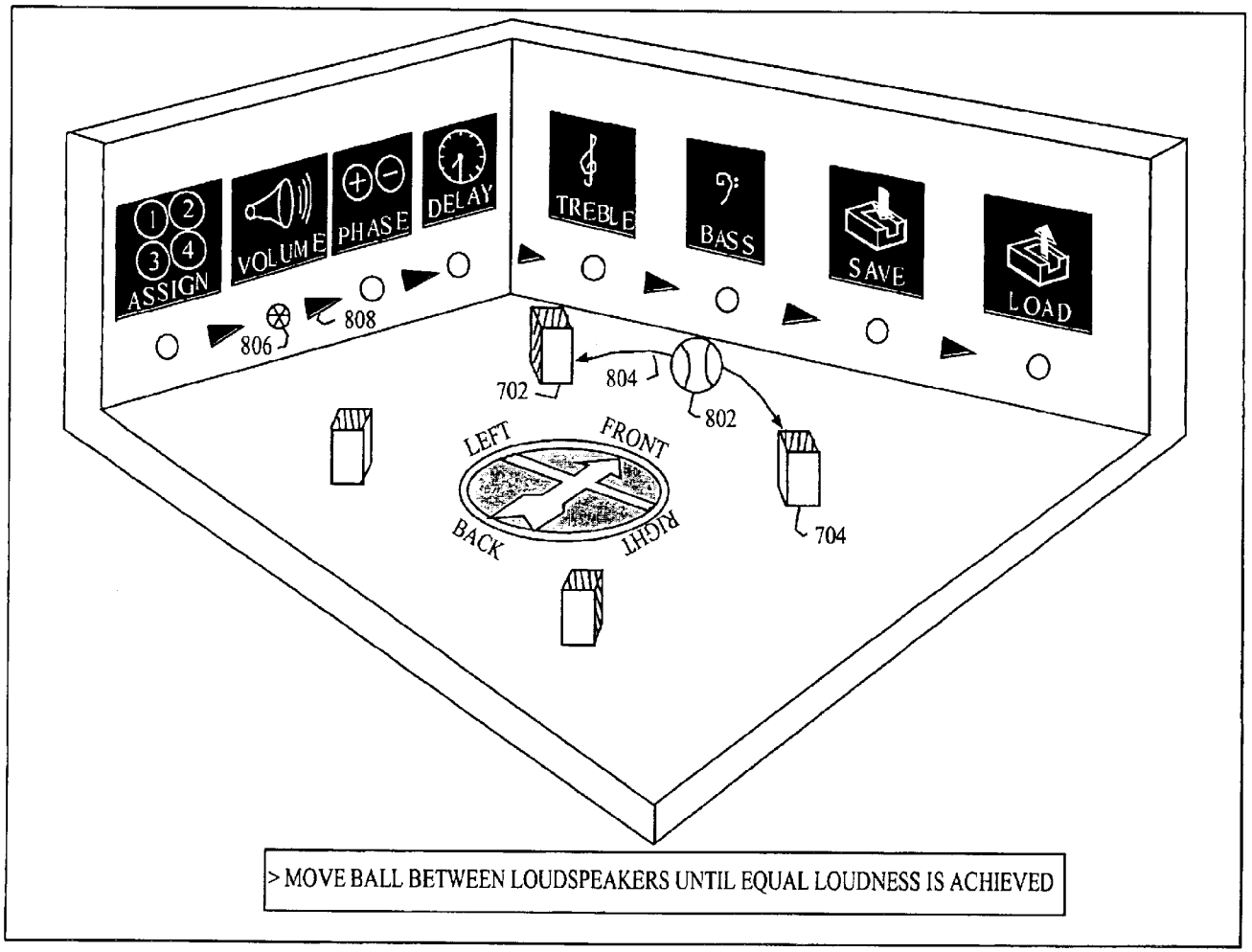
FIG. 9 shows a display screen displayed to a user to provide the volume calibration function.

FIG. 9 shows a display screen displayed to a user to provide the volume calibration function. A ball 802 is placed on a track 804 between the first pair of loudspeakers to be calibrated, for example, loudspeakers 702 and 704. The ball can be moved on the track between the loudspeaker pair by clicking and dragging the ball with the user input device, for example, the mouse. A volume test signal is played through the two loudspeakers and the user moves the ball toward one loudspeaker or the other until the sound perceived by the user appears to be balanced between the two loudspeakers.

In one embodiment, the volume calibration signal contains mostly middle frequencies, and two different signals are played over the two channels. These two sound signals are such that, if played back successively over the same loudspeaker, they appear to be identical. For instance, they are two uncorrelated stationary noise signals that have the same power spectral density. Two such signals could be obtained by splitting a 10-second 1-channel recording of mid-frequency stationary noise into two 5-second sounds. The user is requested to move the ball toward one loudspeaker or the other until the sounds emitted by the two loudspeakers appear to be of equal volume. When the user drags the ball towards one of the two loudspeakers, the two corresponding gain adjusters in the calibration processor 300 are controlled, for instance adjusters 320 and 322. This occurs when the user's feedback is relayed to the controller 344 via the feedback path 352 and the controller sends out instructions via bus 346 to adjust gain adjusters 320 and 322. The gain values for the loudspeaker closer to the ball increases but the total volume of the two loudspeakers is maintained constant. Thus, the gain value for the other channel is reduced in order to preserve the total power of the two channels (i. e. the sum of the squares of the two gains).

In an alternative embodiment of the volume calibration step, the sound signals played over the two loudspeakers are identical signals instead of uncorrelated signals. In this case, the user is requested to move the ball toward one loudspeaker or the other until the sound perceived by the user appears to be centered between the loudspeakers. It is preferable, with this embodiment of the volume calibration, that the phase calibration and either the delay calibration or the loudspeaker placement calibration be completed previously.

When the user is satisfied that the perceived sounds achieve equal loudness, he/she hits the enter key on the keyboard and the calibration system displays another ball and track for another pair of loudspeakers and repeats the same procedure. The test repeats until all the loudspeakers are calibrated for volume. In one embodiment, the next pair of channels to be volume-calibrated has one channel in common with a pair of channels that has previously been calibrated, and user feedback does not affect the relative volumes of channels that have already been volume-calibrated. During the test, the indicator 806 is activated and after the test, the indicator 806 is deactivated and the arrow indicator 808 is activated. At the completion of the volume calibration test, the ball and track images are removed from the display view and the user can proceed to the next function in the calibration process.

Phase Calibration

During phase calibration, the user provides feedback to calibrate the phase of the loudspeakers in the sound system. Parameters derived from this function can be used to set the values of the phase adjusters (312, 314, 316, 318) in the calibration processor 300. Depending on how the loudspeakers have been connected, it is possible that one or more loudspeakers be out of phase with the others. When loudspeakers are out of phase, the sound produced may seem scattered or unfocused, and the perceived volume of bass sounds may be undesirably reduced. To begin the phase calibration, the user clicks on the phase icon 616 and the phase calibration function begins.

Figure 10:
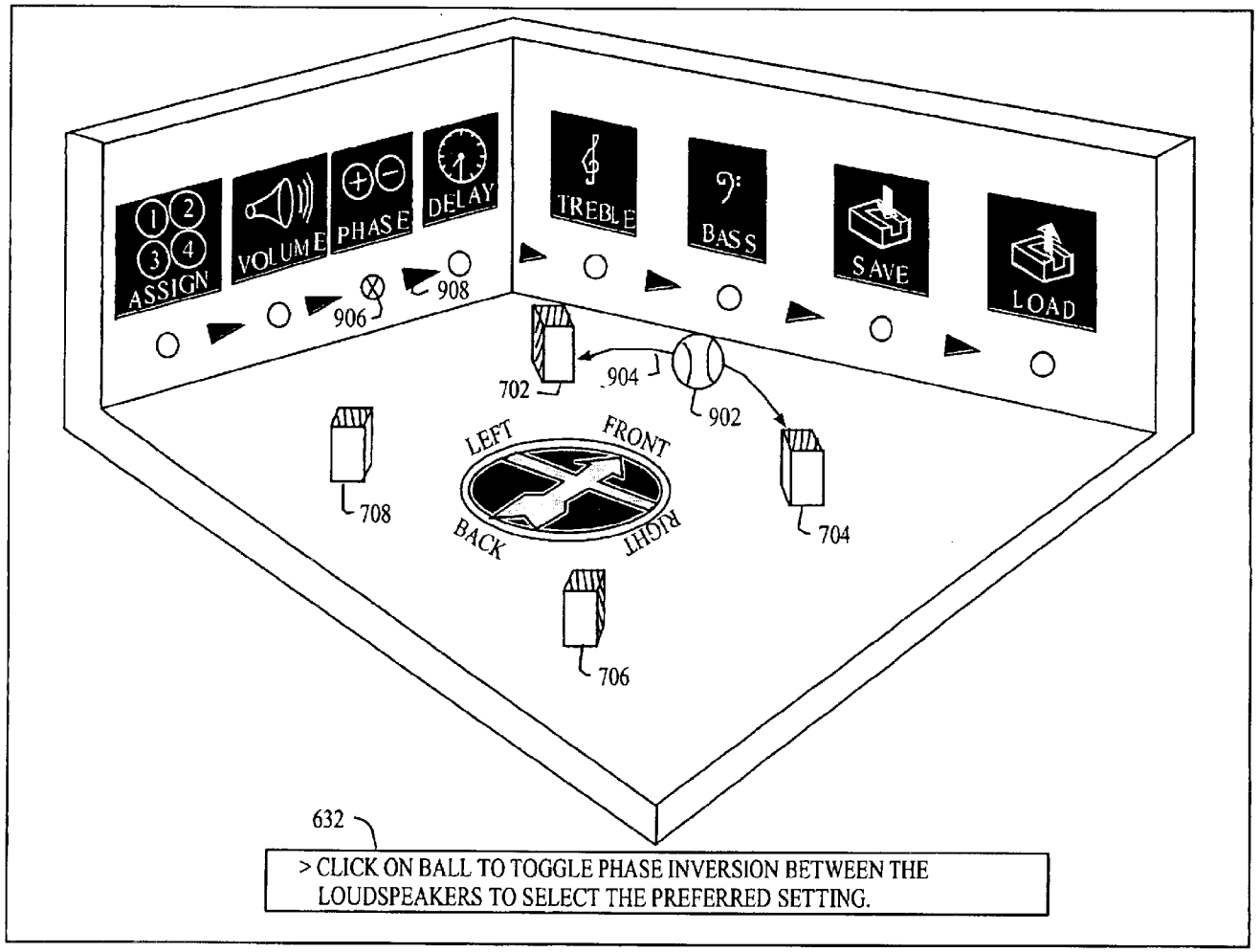
FIG. 10 shows a display screen displayed to the user to provide the phase calibration function.

FIG. 10 shows a display screen displayed to the user to provide the phase calibration function. During phase calibration, two channels are calibrated at a time. A ball 902 is displayed on a track 904 between the first pair of loudspeakers to be calibrated, for example, loudspeakers 702 and 704. The ball cannot be moved between the loudspeaker pair, but can take two colors and the user can toggle between these two colors by clicking on the ball with the user input device, for example, the mouse. To perform the calibration of one channel pair, a phase calibration signal is reproduced over this pair of channels. In one embodiment, the phase calibration signal contains mostly low frequencies (a bass drum sound, for instance), and the same signal is played over the two channels. The dialog box 632 requests that the user click on the ball to toggle the phase inversion until the preferred setting, which provides a more focused and louder sound, is recognized. The user may click multiple times on the ball, where each click changes the color of the ball and results in a phase reversal in the phase adjuster of one of the two corresponding channels in the calibration processor 300, for instance phase adjusters 312 and 314. It is also possible that indicators other than color can be used to represent the relative phase characteristics. For example, the ball may change shape or additional text information can be displayed to indicate selected phase inversions.

Once the user determines that the phase calibration signal is focused and the loudspeakers are in phase, the user hits the enter key on the keyboard and the phase calibration continues with another pair of loudspeakers. In one embodiment, the next pair of channels to be phase-calibrated has one channel in common with a pair of channels that has previously been phase-calibrated, and user feedback therefore toggles the state of the phase adjuster in the other channel. The test repeats until all the loudspeakers are calibrated for the correct phase. For example, loudspeakers 702 and 704 are phase calibrated, and then loudspeakers 702 and 708 are phase calibrated, and then loudspeakers 708 and 706 are phase calibrated. The exact order of calibration may be changed from that described, however, the phase calibration function calibrates all loudspeakers so that all are in phase with each other. During the phase calibration function, the indicator 906 is activated and after the test, the indicator 906 is deactivated and the arrow indicator 908 is activated to direct the user to the next calibration function. At the completion of the phase calibration test, the ball 902 and track 904 images are removed from the screen and the user can proceed to the next function provided by the calibration system.

Delay Calibration

During delay calibration, the user provides feedback to calibrate the sound delay of the loudspeakers in the sound system relative to the position of the user (listener). Parameters derived from this function can be used to set the values of the delay adjusters (304, 306, 308, 310) in the calibration processor 300. The initial values of the delay adjusters are set to $delay_{min}$ or are provided by the loudspeaker placement calibration executed previously. Thus, dependent on the placement of the loudspeakers relative to the user, the associated delay for each loudspeaker is calibrated. During the delay calibration function two loudspeaker channels are calibrated at a time. The user clicks on the delay icon 618 and the delay calibration function begins.

Figure 11:
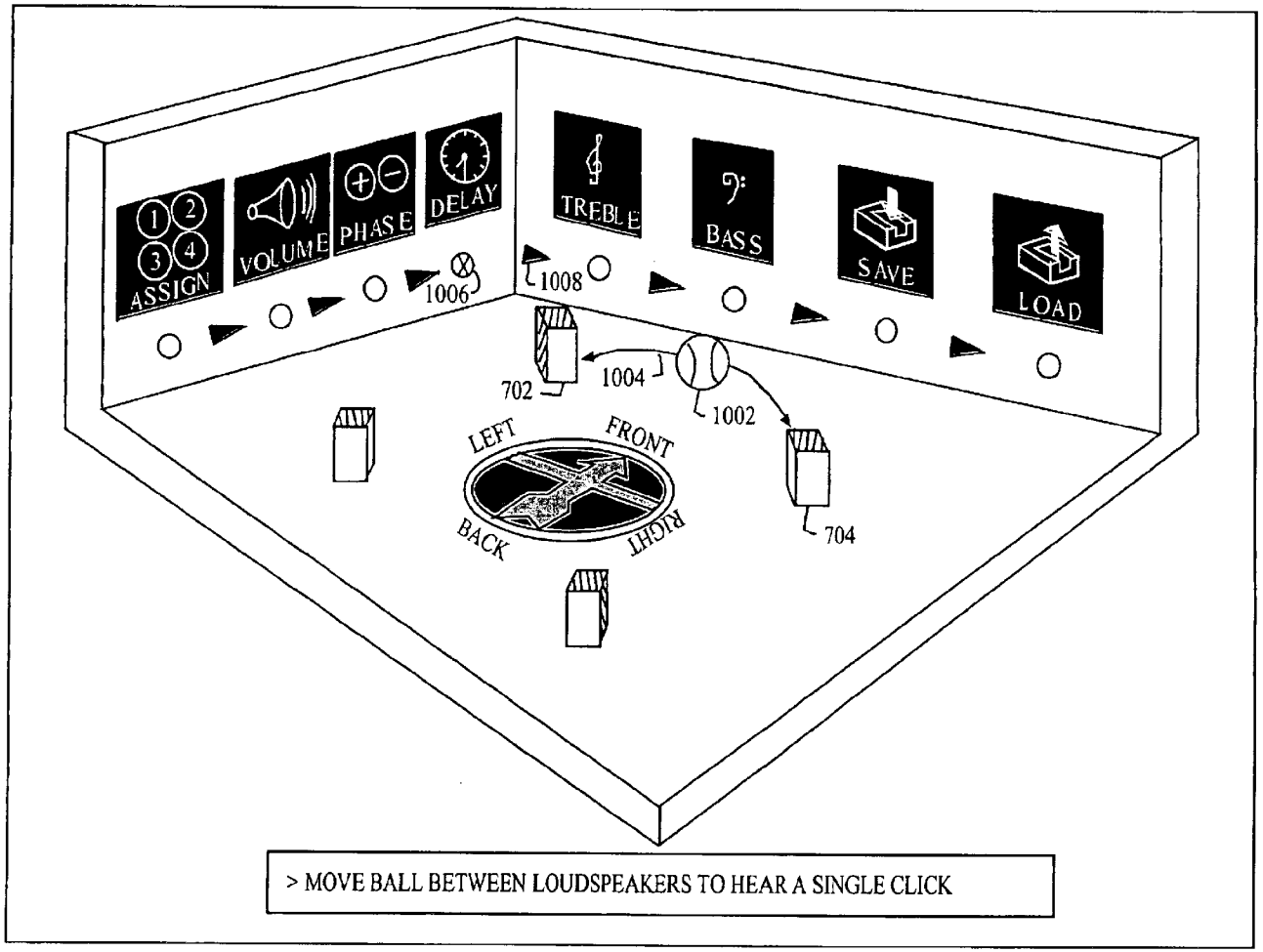
FIG. 11 shows a display screen used to provide the delay calibration function.

FIG. 11 shows a display screen used to provide the delay calibration function. A ball 1002 is placed on a track 1004 between the first pair of loudspeakers to be calibrated, for example, loudspeaker 702 and 704. The ball can be moved between the loudspeaker pair by clicking and dragging the ball with the user input device, for example, the mouse. A delay test signal is played through the two loudspeakers. In one embodiment, the delay test signal contains one or more sharp transient sounds and the same signal is played over the two loudspeakers. For instance, the test signal could be a repeated finger snap sound or a click sound, or a series of clicking sounds. Such sounds will be perceived by the user as "smeared" and lacking focus until the delays of the two channels are adjusted so that any sound emitted simultaneously by the two loudspeakers arrives simultaneously at the listening position. The user moves the ball toward one loudspeaker or the other until the sound perceived by the user is perceived to be a crisp, sharp sound. When the user drags the ball towards one of the two loudspeakers, the two corresponding delay adjusters in the calibration processor 300 are controlled, for instance adjusters 304 and 306. This occurs, for example, when the user feedback is provided to the controller 344 via feedback path 352, and the controller then controls the operation of the adjusters 304 and 306. The delay value for the loudspeaker further from the ball is increased, while the delay for the other loudspeaker remains unchanged.

When the user is satisfied with the perceived sounds and the corresponding delay settings, he/she hits the enter key on the keyboard and the calibration system displays another ball and track for another pair of loudspeakers and repeats the same procedure. The test repeats until all the loudspeakers are calibrated for delay relative to the position of the user. In one embodiment, the next pair of channels to be delay-calibrated has one channel in common with a pair of channels that has previously been delay-calibrated, and user feedback does not affect the relative delays of channels that have already been delay-calibrated. During the test, the indicator 1006 is activated and after the test the indicator 1006 is deactivated and the arrow indicator 1008 is activated. At the completion of the delay calibration test, the ball 1002 and track 1004 images are removed and the user can proceed to the next function provided by the calibration system.

Treble and Bass Calibration

The calibration system provides treble 620 and bass 622 calibration icons that the user can click on to activate the corresponding calibration functions. Since the treble and bass calibrations are conducted in a similar manner, they will be described together in this section. This type of calibration may be required if, for example, the loudspeakers have different frequency response characteristics because they are manufactured by different manufacturers. The placement of the loudspeakers relative to the walls of the listening room may also cause a reinforcement of certain frequencies for certain loudspeakers in the sound system. Such differences of frequency response between the loudspeakers can be addressed, at least in part, by treble or bass calibration.

During treble calibration and bass calibration, the user provides feedback to calibrate the sound treble and bass volume of the loudspeakers in the sound system. Parameters derived from these functions can be used to set the values of the equalization adjusters (328, 330, 332, 334) in the calibration processor 300. The equalization adjusters provide independent adjustment of the low-frequency gain and the high-frequency gain for each channel in the sound system to be calibrated. The cross-over frequencies, which define the low-frequency and high-frequency regions in the frequency scale, can also be adjusted, but are left unchanged in the present treble and bass calibration steps. The mid-frequency gain (gain at medium frequencies) can be adjusted too, but it is left unchanged in the treble and bass calibration steps, because the volume at medium frequencies is adjusted by the volume calibration function.

Figure 12:
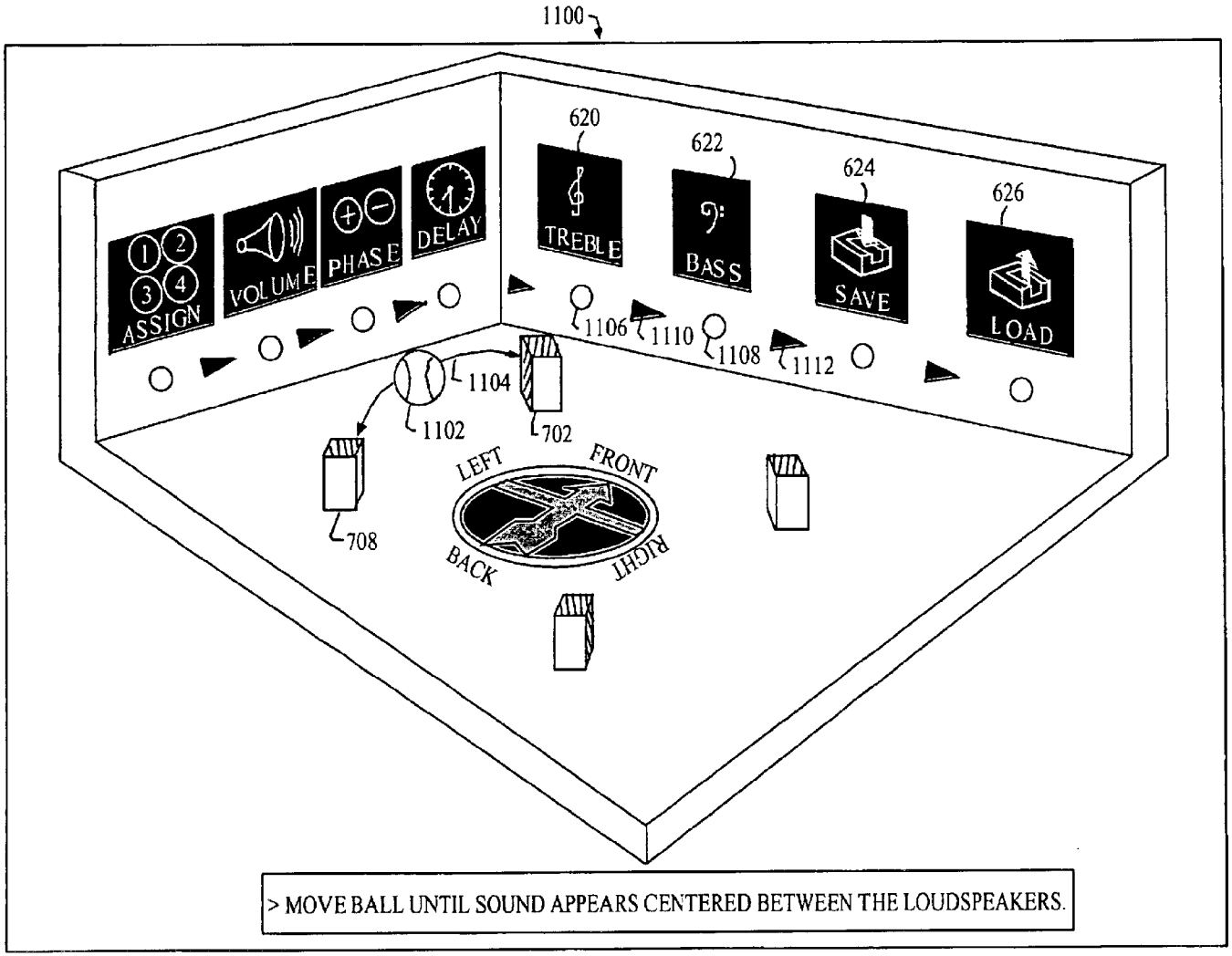
FIG. 12 shows a display screen used to provide the treble or bass calibration function.

FIG. 12 shows a display screen used to provide the treble or bass calibration function. A ball 1102 is placed on a track 1104 between the first pair of loudspeakers to be calibrated, for example, loudspeakers 702 and 708. The ball can be moved between the loudspeaker pair by clicking and dragging the ball with the user input device, for example, the mouse.

For bass calibration, a bass calibration signal is played through the two loudspeakers. In one embodiment, the bass calibration signal contains mostly low frequencies (for example, a bass drum sound) and the same signal is played over the two loudspeakers. The user is requested to move the ball toward one loudspeaker or the other until the sound perceived by the user appears centered between the loudspeakers. When the user drags the ball towards one of the two loudspeakers, the two corresponding equalization adjusters in the calibration processor 300 are controlled, for instance adjusters 328 and 334. As described above, the controller 344 controls the adjusters based on user input received via the feedback path 352. The low-frequency gain value for the loudspeaker closer to the ball is increased but the total low-frequency volume of the two loudspeakers is maintained constant. Thus, the low-frequency gain value for the other channel is reduced in order to preserve the total amplitude of the two channels (i. e. the sum of the two gains).

Treble calibration is conducted in a manner identical to bass calibration, except that the treble calibration signal contains mostly high frequencies (for instance, a cymbal sound). Furthermore, in order to maintain the total high-frequency volume of the two loudspeakers, the total power of the two channels (i. e. the sum of the squares of the two gains) is preserved, instead of the total amplitude.

When the user is satisfied that the perceived sounds are centered, he/she hits the enter key on the keyboard and the calibration system displays another ball and track for another pair of loudspeakers and repeats the same procedure. The test repeats until all the loudspeakers are calibrated for treble or bass response. In one embodiment, the next pair of channels to be calibrated for treble or bass response has one channel in common with a pair of channels that has previously been calibrated, and user feedback does not affect the relative low-frequency or high-frequency gain adjustments in channels that have already been calibrated. During the calibration, indicators 1106 or 1108 are activated depending on the calibration being performed. After each calibration, arrow indicators 1110 or 1112 may be activated to direct the user to the next step in the calibration. At the completion of the treble or bass calibration, the ball 1102 and track 1104 images are removed and the user can proceed to the next function in the calibration.

The treble and bass calibration functions are not intended to address the correction of the global frequency response of the sound system. The goal of the treble and bass calibration is to reduce frequency response differences between the channels. If a correction of the global frequency response of the sound system is necessary, it can be done, for instance, using the equalization adjusters (328, 330, 332, 334) included in the calibration processor 300. This can be achieved by providing global treble and bass volume controls to the user, which have the effect of applying the same low-frequency or high-frequency gain correction in all channels of the sound system. These global corrections and the per-channel corrections resulting from the treble and bass calibration are combined, in each channel, by multiplying the gain values (or, equivalently, by adding the decibel values), for low frequencies and for high frequencies.

Saving Calibration Parameters

Referring again to FIG. 12, a save icon 624 can be activated by the user to save the results of a completed calibration. After the user clicks on the save icon 624, a summary display screen is displayed that summarizes the current settings of calibration parameters associated with the calibration functions described herein.

Figure 13:
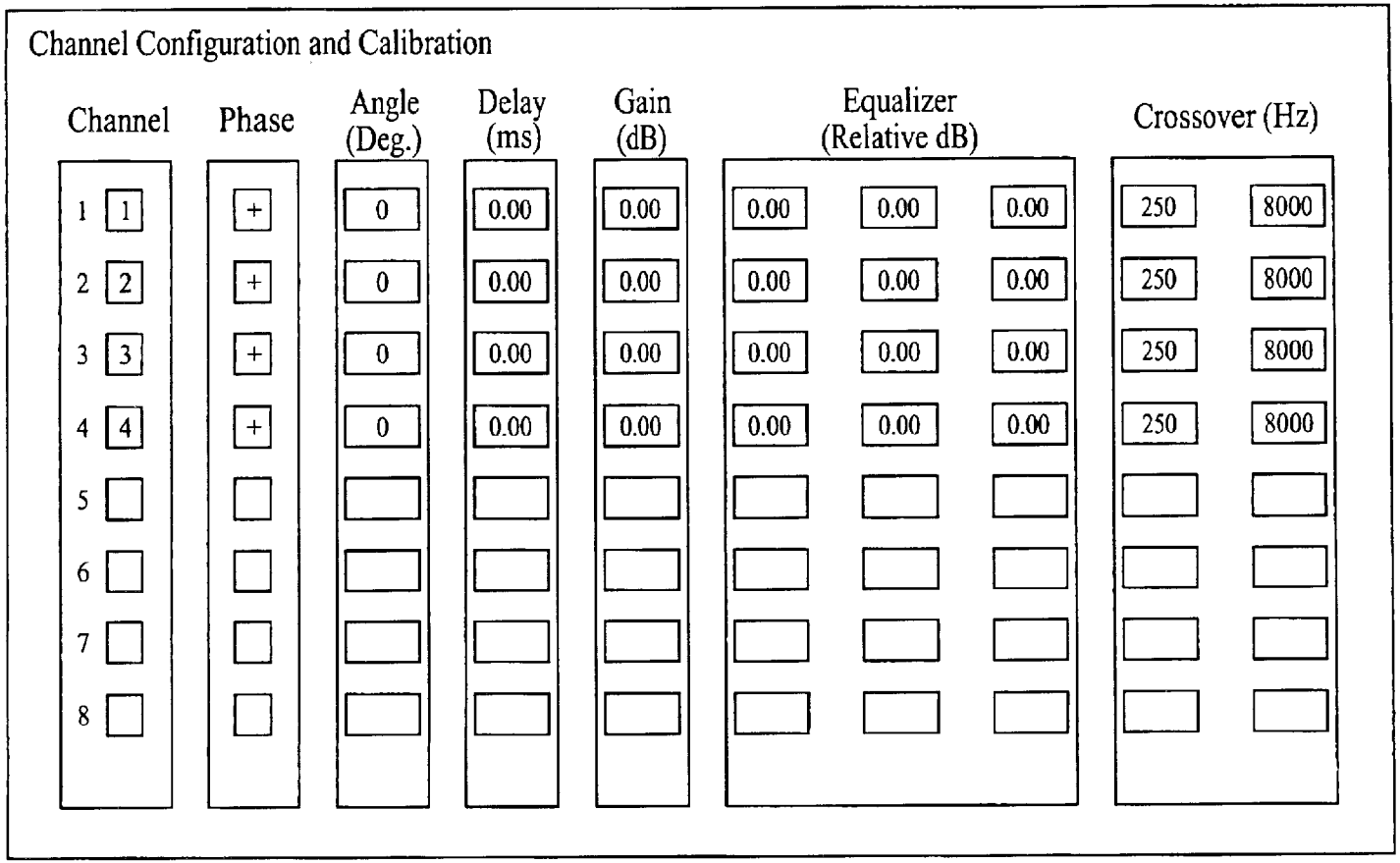
FIG. 13 shows a summary display screen that displays calibration parameters that are to be used in conjunction with the user's sound system.

FIG. 13 shows an exemplary summary display screen that displays calibration parameters that are to be used in conjunction with the user's sound system. The user can save these parameters in a system memory for later recall. The user can also edit the calibration parameters directly. For example, the user may click into one of the parameter boxes and change the displayed parameter value. Thus, it is possible for the user to form multiple parameter sets by saving a current parameter set to memory and then editing one or more parameter values and saving the edited parameter set to memory under a new name.

Recalling Calibration Parameters

Referring again to FIG. 12, a load icon 626 can be activated by the user to load the results of a saved calibration. After the user clicks on the load icon 626, a summary display screen is displayed that summarizes the current settings of calibration parameters associated with the calibration functions described herein (see FIG. 13).

Once the summary screen is displayed, the user can activate these parameters for use, or can edit the calibration parameters directly. For example, the user may click into one of the parameter boxes and change the displayed parameter value. Thus, it is possible for the user to load default calibration parameters from memory and edit one or more parameter values to form a new calibration parameter set.

Once a calibration parameter set is created by the user or retrieved from memory, the user can reenter the calibration system to perform any or all of the calibration functions again. Thus, it is possible for the user to load a default calibration parameter set, activate the calibration system to use the default parameter set, and thereafter, perform any of the calibration functions to update or confirm the current calibration parameters.

Embodiment for Advanced Users

Figure 14:
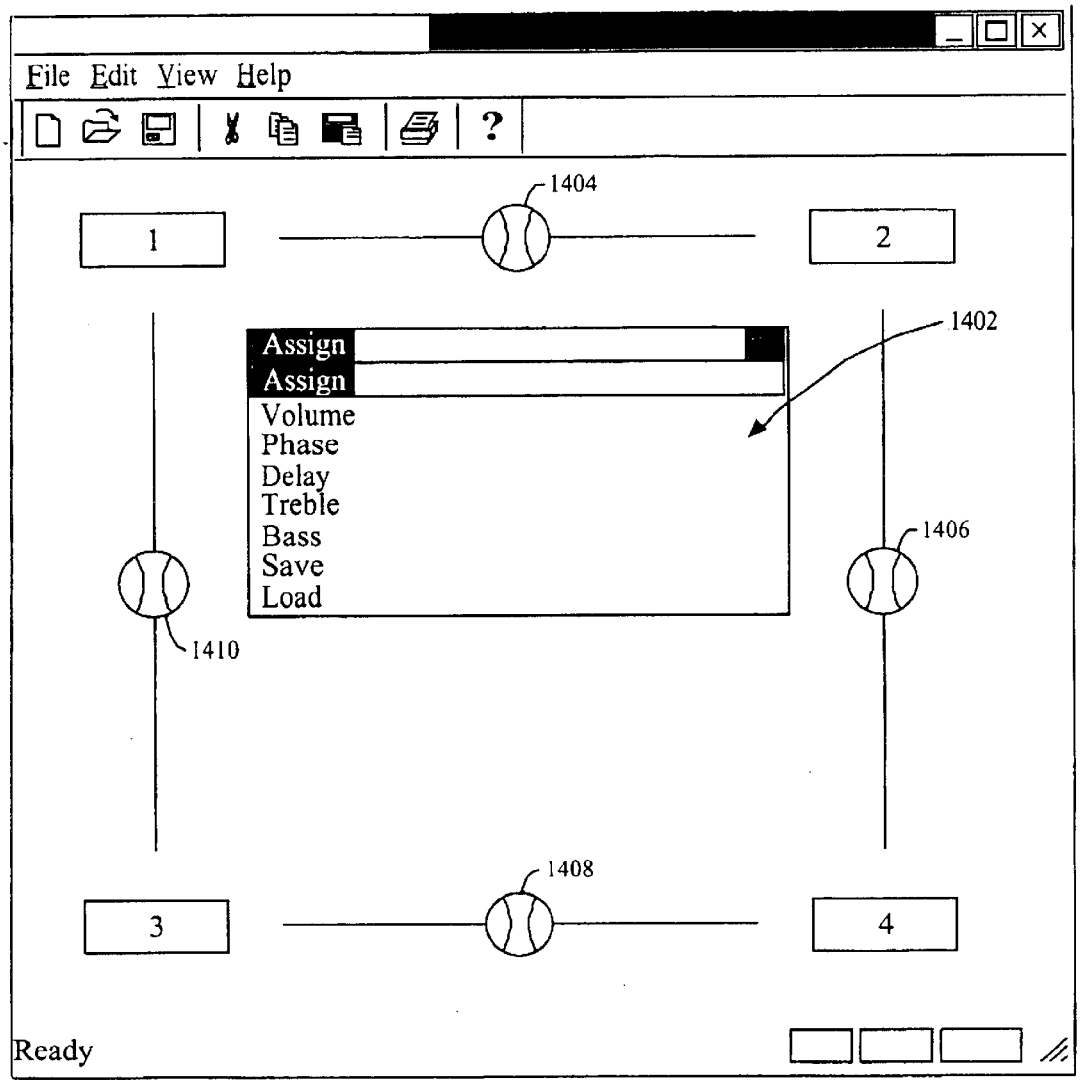
FIG. 14 shows an advanced user display screen that allows advanced users to calibrate a multi-channel sound system in accordance with the present invention.

FIG. 14 shows an advanced user display screen that allows advanced users to calibrate a sound system in accordance with the present invention. The advanced display screen includes a drop-down menu 1402 that allows a user to select a calibration function to perform. Also included in the advanced display screen are loudspeaker buttons 1, 2, 3 and 4 and ball icons 1404, 1406, 1408, 1410 and associated slider tracks. Thus, it is possible for a user to select a calibration function from the drop-down menu and perform the calibration by clicking on the loudspeaker buttons and/or sliding the ball icons on the slider tracks. For example, the volume calibration can be performed by selecting the volume calibration from the drop down menu, clicking on a selected ball icon to activate the appropriate test signals, and sliding the selected ball icon between loudspeaker buttons that represent the active loudspeakers. The active loudspeakers are represented by highlighting that appears on the loudspeaker buttons.

In another example, the phase calibration is accomplished when, after selecting the phase calibration function from the drop down menu, two or more loudspeaker buttons are highlighted and the color of each button is changed corresponding to the relative phase of the corresponding loudspeaker. Thus, by clicking on the ball located between the highlighted loudspeakers, the user can change the phase of the highlighted loudspeakers until a focused sound is achieved. The user can then activate another loudspeaker pair and proceed through the same calibration until all the loudspeaker phases have been calibrated.

In one embodiment the above described functions are provided when the controller 344 controls the elements of the processor 300 in response to feedback received from the user via the feedback input path 352. It is also possible that controller 352 receives instructions directly over the calibration path 354 as to how the elements of the processor 300 should be controlled. Thus, various hardware arrangements are possible to implement the present invention so that the described embodiments are not restricted to a specific hardware implementation.

The present invention provides an interactive system for calibration of multichannel sound systems. The invention provides the calibration using user feedback that is based on the user's perception of test sounds heard at a listening position. Thus, it is possible to calibrate out sound distortions that may be introduce by speaker positions, room acoustics or other sources. It will be apparent to those with skill in the art that modifications to the above embodiments can occur without deviating from the scope of the present invention. Accordingly, the disclosures and descriptions herein are intended to be illustrative, but not limiting, of the scope of the invention which is set forth in the following claims.

What is claimed is:

1. A method for calibrating a sound system that includes a plurality of loudspeakers, the method comprising steps of:

mapping the plurality of loudspeakers into a virtual loudspeaker system representation displayable to a user;

activating at least one calibration function that creates a calibration signal that is reproduced by one or more of the plurality of loudspeakers to produce a calibration sound perceivable by the user;

modifying the virtual loudspeaker system representation to include a virtual calibration indicator that indicates a characteristic of the calibration signal; and adjusting the virtual calibration indicator based on a user input, wherein when the virtual calibration indicator is adjusted, a corresponding adjustment is made to the characteristic of the calibration signal until a selected calibration sound is achieved.

2. Apparatus for calibrating a sound system that includes a plurality of loudspeakers, the apparatus comprising:

means for mapping the plurality of loudspeakers into a virtual loudspeaker system representation displayable to a user;

means for activating at least one calibration function that creates a calibration signal that is reproduced by one or more of the plurality of loudspeakers to produce a calibration sound perceivable by the user;

means for modifying the virtual loudspeaker system representation to include a virtual calibration indicator that indicates a characteristic of the calibration signal; and means for adjusting the virtual calibration indicator based on a user input, wherein when the virtual calibration indicator is adjusted, a corresponding adjustment is made to the characteristic of the calibration signal until a selected calibration sound is achieved.

3. Apparatus for calibrating a sound system that includes a plurality of loudspeakers, the apparatus comprising:

a display;

an input device operable by a user;

a sound generator coupled to the loudspeakers, the sound generator generates at least one calibration signal that has at least one characteristic, the at least one calibration signal is reproduced by one or more of the loudspeakers to produce a calibration sound that is perceivable by the user; and a processor coupled to the display, the input device and the sound generator, the processor operable to:

map the plurality of loudspeakers into a virtual loudspeaker system representation that is displayable to the user on the display;

activate the sound generator to generate the at least one calibration signal;

modify the virtual loudspeaker system representation to include a virtual calibration indicator that indicates the at least one characteristic of the at least one calibration signal; and adjust the virtual calibration indicator based on a user input from the input device, wherein when the virtual calibration indicator is adjusted, a corresponding adjustment is made to the characteristic of the calibration signal until a selected calibration sound is achieved.

4. A computer-readable medium having stored thereon instructions which, when executed by a processor in a multi-channel loudspeaker system, cause the processor to:

map a plurality of loudspeakers into a virtual loudspeaker system representation displayable to a user;

receive a user input that activates at least one calibration function that creates a calibration signal that is reproduced by one or more of the plurality of loudspeakers to produce a calibration sound perceivable by the user;

modify the virtual loudspeaker system representation to include a virtual calibration indicator that indicates a characteristic of the calibration signal; and adjust the virtual calibration indicator based on a user input, wherein when the virtual calibration indicator is adjusted, a corresponding adjustment is made to the characteristic of the calibration signal until a selected calibration sound is achieved.

5. A method for calibrating a sound system that includes a plurality of loudspeakers, the method comprising steps of:

mapping the plurality of loudspeakers into a virtual loudspeaker system representation displayable to a user;

modifying the virtual loudspeaker system representation to represent a physical arrangement of the plurality of loudspeakers with respect to a listening position; and determining calibration parameters based on the modified virtual loudspeaker representation, wherein the sound system is calibrated with the calibration parameters.

* * * * *